US011795682B2

(12) United States Patent
Igarashi et al.

(10) Patent No.: US 11,795,682 B2
(45) Date of Patent: Oct. 24, 2023

(54) PLANT CONSTRUCTION MODULE, PLANT, MANUFACTURING METHOD FOR PLANT CONSTRUCTION MODULE, AND PLANT CONSTRUCTION METHOD

(71) Applicant: JGC CORPORATION, Kanagawa (JP)

(72) Inventors: Hiroteru Igarashi, Kanagawa (JP); Atsuo Honiden, Kanagawa (JP); Noriaki Terakubo, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 154 days.

(21) Appl. No.: 17/428,271

(22) PCT Filed: Jun. 3, 2019

(86) PCT No.: PCT/JP2019/021957
§ 371 (c)(1),
(2) Date: Aug. 3, 2021

(87) PCT Pub. No.: WO2020/245868
PCT Pub. Date: Dec. 10, 2020

(65) Prior Publication Data

US 2022/0106784 A1 Apr. 7, 2022

(51) Int. Cl.
*E04B 1/348* (2006.01)
*E04H 5/02* (2006.01)

(52) U.S. Cl.
CPC ..... *E04B 1/34869* (2013.01); *E04B 1/34861* (2013.01); *E04H 5/02* (2013.01)

(58) Field of Classification Search
CPC ... E04H 5/02; E04H 2001/1283; E04H 1/005; E04H 7/02; E04B 1/167; E04B 1/34869; E04B 1/34861
See application file for complete search history.

(56) References Cited

U.S. PATENT DOCUMENTS 3,925,679 A * 12/1975 Berman ..... F01K 13/00 290/1 R
9,376,801 B1 * 6/2016 Warren ..... E04H 5/00
(Continued)

FOREIGN PATENT DOCUMENTS

JP 2015143560 8/2015
JP 2018049854 3/2018
(Continued)

OTHER PUBLICATIONS

"International Search Report (Form PCT/ISA/210) of PCT/JP2019/021957," dated Jul. 30, 2019, with English translation thereof, pp. 1-5.

*Primary Examiner* — Gisele D Ford
(74) *Attorney, Agent, or Firm* — JCIPRNET

(57) ABSTRACT

To provide a plant construction module that is easily manufactured and easily transported. Provided is a plant construction module (10) for a plant configured to process fluid, the plant construction module including: a plant structural part (3, 12) including a pipe structural part (3) serving as a piping through which the fluid flows, a processing-unit structural part (21) serving as a processing unit configured to process the fluid to be transferred into/from the processing unit through the piping; and a frame unit (11), which has a contour enabling the frame unit to be arranged in a horizontal direction, or to be stacked in an up-and-down direction, wherein the plant structural part (3, 12) and the frame unit (11) have an integrated structure.

9 Claims, 10 Drawing Sheets

(56) References Cited

U.S. PATENT DOCUMENTS 10,711,539 B1* 7/2020 Nolan ..... F24F 7/003
2002/0189173 A1* 12/2002 Staschik ..... E04H 5/02 52/79.1
2008/0123288 A1* 5/2008 Hillis ..... H05K 7/20745 361/679.54
2008/0178537 A1* 7/2008 Spangler ..... B23Q 37/00 52/36.1
2011/0024078 A1* 2/2011 Tong ..... E04H 5/02 165/47
2013/0283855 A1* 10/2013 Rampp ..... F25J 3/0489 62/643
2014/0053599 A1* 2/2014 Byfield ..... F25J 1/0022 29/890.035
2014/0161638 A1* 6/2014 Lardy ..... F16M 5/00 29/888.021
2015/0001161 A1* 1/2015 Wiemers ..... E21B 43/34 210/201
2015/0240474 A1* 8/2015 Kokoschka ..... E04B 1/34384 52/745.02
2015/0291348 A1* 10/2015 Lopez ..... B65D 90/587 220/1.5
2015/0368136 A1* 12/2015 Raymont ..... C02F 1/001 210/96.1
2016/0032606 A1* 2/2016 Simmons ..... E04H 7/18 52/745.01
2016/0273271 A1* 9/2016 Morrell ..... E04H 5/02
2016/0319560 A1* 11/2016 Khong ..... F02B 43/10
2017/0044754 A1* 2/2017 Aguila ..... E04H 1/005
2017/0260767 A1* 9/2017 Shimono ..... E04B 1/36
2018/0058060 A1* 3/2018 Anderson ..... E04B 1/34861
2018/0109163 A1* 4/2018 Paine ..... E04H 5/04
2018/0230690 A1* 8/2018 Leibinger ..... E04H 3/08
2018/0238770 A1* 8/2018 Annunen ..... E04B 1/941
2018/0297878 A1* 10/2018 Raymont ..... C02F 9/20
2019/0041127 A1* 2/2019 Giancotti ..... F02C 7/20
2019/0055887 A1* 2/2019 Giancotti ..... F25J 1/0022
2019/0083691 A1* 3/2019 Gauthier ..... E04H 3/08
2019/0136519 A1* 5/2019 Binder ..... E04B 1/10
2019/0364698 A1* 11/2019 Johnson ..... E04H 5/02
2020/0300540 A1* 9/2020 Kagawa ..... F25J 1/0259
2020/0309450 A1* 10/2020 Morley ..... F25J 1/0244
2021/0372116 A1* 12/2021 Hillenburg ..... E04B 1/34861
2022/0088559 A1* 3/2022 Yeo ..... G21F 9/22

FOREIGN PATENT DOCUMENTS

JP 6378699 8/2018
JP 2018144070 9/2018
JP 2018154093 10/2018
JP 6513554 5/2019
WO 2014028961 2/2014
WO 2019008725 1/2019

* cited by examiner

PLANT CONSTRUCTION MODULE, PLANT, MANUFACTURING METHOD FOR PLANT CONSTRUCTION MODULE, AND PLANT CONSTRUCTION METHOD

CROSS-REFERENCE TO RELATED APPLICATION

This application is a 371 application of the international PCT application serial no. PCT/JP2019/021957, filed on Jun. 3, 2019. The entirety of the above-mentioned patent application is hereby incorporated by reference herein and made a part of this specification.

TECHNICAL FIELD

The present invention relates to a technology for constructing a plant.

BACKGROUND ART

Examples of a plant for processing fluid include a natural gas plant for liquefying natural gas and separating/recovering a natural gas liquid, a petroleum refining plant for distilling and desulfurizing crude oil or various intermediate products, and a chemical plant for producing a petrochemical product, an intermediate chemical product, and a polymer.

Those plants have a structure in which a group of a large number of devices including static devices, such as columns, tanks, and heat exchangers, dynamic devices, such as pumps, and piping provided among those static devices and dynamic devices, are arranged in, for example, a steel frame work or a periphery thereof.

For example, in a liquefied natural gas (LNG) plant for liquefying natural gas, the following efforts have been made to achieve modularization. Specifically, a large number of devices forming the LNG plant are divided into blocks, and a group of devices in each block is assembled into a common frame work (for example, Patent Literature 1).

Modules constructed in some other place are conveyed to an installation site, and the modules are connected together. Thus, a plant is constructed.

However, when a large-sized plant is constructed, the modules themselves are increased in size, and a super-large-sized transport ship capable of conveying the modules is required in some cases. The operation number of such transport ships is small, and a ship allocation schedule for several years ahead is already occupied in some cases. Accordingly, there is a fear in that such allocation of the transport ships may become constraint to affect a construction schedule for the plant.

Meanwhile, when a large-sized plant is constructed through combination of a large number of small-sized modules, construction work for the individual modules is complicated.

CITATION LIST

Patent Literature

[Patent Literature 1] WO 2014/028961 A1

SUMMARY OF INVENTION

Technical Problem

The present invention has been made in view of such backgrounds, and provides a plant construction module that is easily manufactured and easily transported.

Solution to Problem

According to the present invention, there is provided a plant construction module for a plant configured to process fluid, the plant construction module including: a plant structural part including at least one of: a pipe structural part serving as a piping through which the fluid flows; a processing-unit structural part serving as a processing unit configured to process the fluid to be transferred into/from the processing unit through the piping; or a reservoir structural part serving as a reservoir configured to reserve the fluid; and a frame unit, which is configured to support the plant structural part, and has a contour enabling the frame part to be arranged in a horizontal direction, or to be stacked in an up-and-down direction, wherein the plant structural part and the frame unit have an integrated structure.

In the plant construction module, the plant structural part and the frame unit are integrally formed by a 3D printer.

The plant construction module may have the following features.

(a) The plant construction module further includes a cable part, which is supported by the frame unit, and serves as a power supply cable configured to supply power for driving a dynamic device, or a signal cable configured to input and output a signal of an instrumentation device, wherein the cable part has an integrated structure with the plant structural part and the frame unit.

(b) The contour of the frame unit has a rectangular parallelepiped shape. In this case, the frame unit having the rectangular parallelepiped shape has such a dimension that enables transportation by a container transport ship.

Further, according to the present invention, there is provided a plant, including: a plurality of the plant construction modules arranged in a horizontal direction, or stacked in an up-and-down direction; and at least one of: a piping formed by connecting together the pipe structural parts of the plant construction modules that abut on each other in the horizontal direction or the up-and-down direction; and at least one of: a processing unit, which is formed by the processing-unit structural part, and into which the fluid is to be fed through the piping; or a reservoir, which is formed by the reservoir structural part, and into which the fluid is to be fed through the piping.

Advantageous Effects of Invention

In the plant construction module according to the present invention, the plant structural part and the frame unit have the integrated structure. The plant structural part serves as the piping, the processing unit, or the reservoir, which construct the plant. The frame unit has the contour enabling the frame section to be arranged in the horizontal direction, or to be stacked in the up-and-down direction. Accordingly, in structural respects, the plant construction module is suitable for integral forming (manufacture) performed by a 3D printer. Further, the large-sized plant is easily constructed by the divided plant construction modules each having a size suitable for transportation.

DESCRIPTION OF EMBODIMENTS

Figure 1:
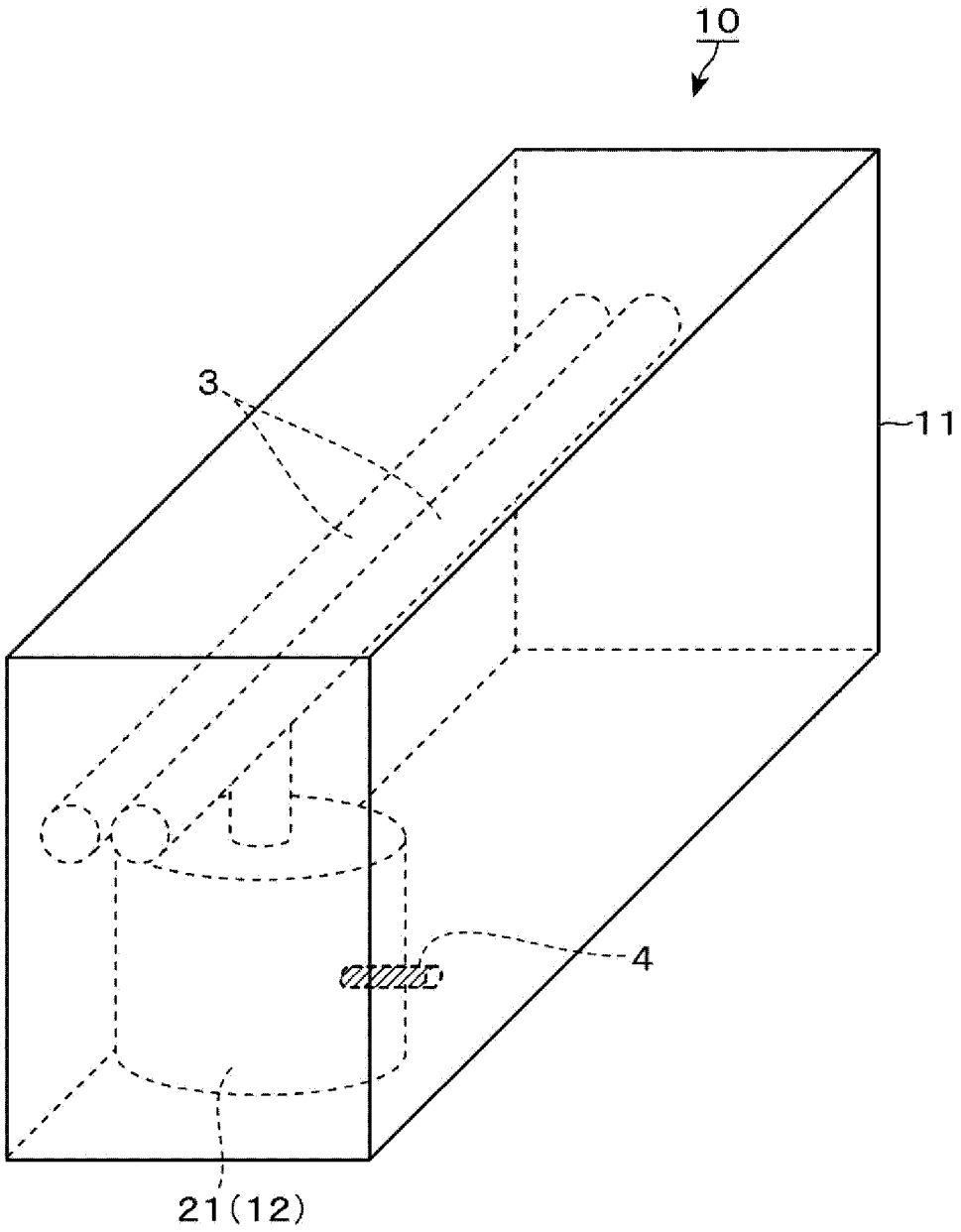
FIG. 1 is a schematic view for illustrating a plant construction module.

FIG. 1 is a schematic view for illustrating a plant construction module (hereinafter, also simply referred to as "module") 10 according to one embodiment of the present invention. The module 10 includes a frame unit 11, a pipe structural part 3 arranged in the frame unit 11, a static device structural part 12 (processing-unit structural part or reservoir structural part to be described later), and a cable part 4.

For example, the frame unit 11 has a contour having a rectangular parallelepiped shape (including a cubic shape). A plurality of frame units 11 are arranged in a horizontal direction, or stacked in an up-and-down direction, thereby being capable of constructing a plant 1. The frame unit 11 is made of a structural material such as a metal material, a ceramic material, or a resin material. Each of the frame units 11 supports, for example, the pipe structural part 3, the static device structural part 12, and the cable part 4, which are arranged inside the frame unit 11. Further, each of the frame units 11 has strength high enough to support another frame unit 11 to be stacked on the frame unit 11.

The frame unit 11 may have a frame structure such as a truss structure or a rigid-frame structure, or may have a honeycomb structure or a lattice structure. Further, in addition to a sparse structure having gaps between structural members, such as the frame structure, the honeycomb structure, or the lattice structure, the frame unit 11 may have a solid structure in which the frame unit 11 is partially or entirely filled with the structural members of the frame unit 11, except for spaces occupied by the pipe structural part 3 and the static device structural part 12.

For example, as a contour dimension of the frame unit 11 having a rectangular parallelepiped shape, there can be given a case in which the frame unit 11 is formed so as to conform to a container size (such as a 20 feet container or a 40 feet container compliant with ISO6346) that enables transportation by a general container transport ship. The frame unit 11 may be conveyed under a state of being accommodated in the container described above, or may be conveyed under a state of being uncovered without being accommodated in the container. In the former case, the frame unit 11 is formed so as to have a contour dimension enabling the frame unit 11 to be accommodated in the container. In the latter case, the frame unit 11 is formed so as to have substantially the same contour dimension as that of the container.

Figure 2:
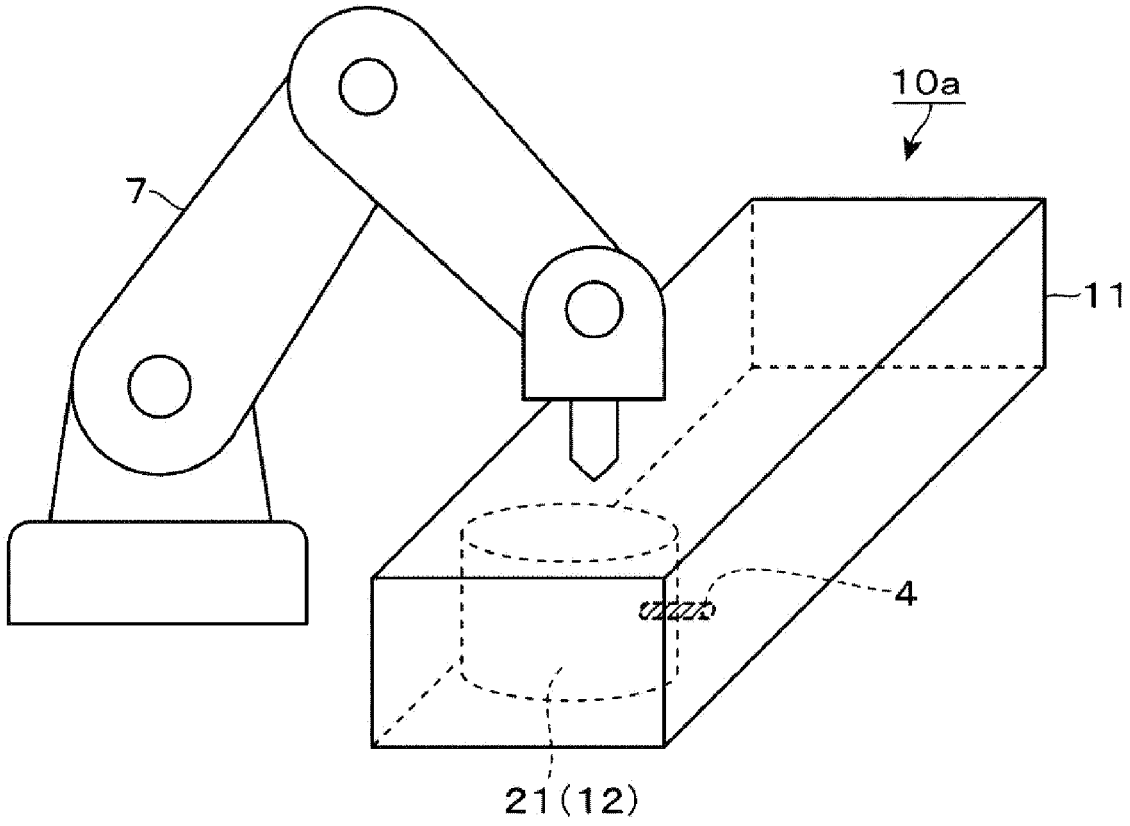
FIG. 2 is an explanatory view for illustrating manufacturing steps for the module.

In the frame unit 11, the pipe structural part 3, the processing-unit structural part, or the reservoir structural part is arranged (in FIG. 1 and FIG. 2, an example of the processing-unit structural part being a processing column 21 is illustrated). The pipe structural part 3 serves as a piping through which fluid to be processed by the plant 1 flows. The processing-unit structural part serves as a processing unit configured to process the fluid to be transferred into/from the processing unit through the pipe structural part 3. The reservoir structural part serves as a reservoir configured to reserve the fluid. The processing-unit structural part and the reservoir structural part are also collectively referred to as the static device structural part 12. The pipe structural part 3, the processing-unit structural part, and the reservoir structural part correspond to a plant structural part in the embodiment of the present invention.

A diameter and a length of the piping formed by the pipe structural part 3 are not particularly limited. Further, the fluid flowing in the piping may be liquid, gas, or a multiphase flow. As a material for forming the pipe structural part 3, there is selected, for example, a metal material, a ceramic material, or a resin material having strength and corrosion resistance in accordance with, for example, a temperature, a pressure, and a chemical property of the fluid flowing in the piping. Further, an inner surface of the pipe structural part 3 may be lined with a lining material, or an outer surface of the pipe structural part 3 may be covered with a heat insulating material.

As examples of the processing units, there can be given various processing devices provided in the plant 1, which include the processing column 21 configured to perform various kinds of processing, such as reaction, distillation, absorption, and extraction, on fluid to be processed, a heat exchanger 22 configured to heat and cool the fluid, a cyclone configured to separate another fluid contained in the fluid, and an ejector configured to form a vacuum atmosphere. A component that is arranged in the frame unit 11 and forms the entirety or part of the above-mentioned processing unit corresponds to the processing-unit structural part in the embodiment of the present invention.

As examples of the reservoirs, there can be given various tanks, which include a receiver tank 23 arranged at an outlet of a cooler being the heat exchanger 22 configured to cool vapor. A component that is arranged in the frame unit 11 and forms the entirety or part of the above-mentioned reservoir corresponds to the reservoir structural part in the embodiment of the present invention.

As a material for forming the processing-unit structural part or the reservoir structural part described above, there is also selected, for example, a metal material, a ceramic material, or a resin material having strength and corrosion resistance to cope with, for example, a temperature, a pressure, and a chemical property of the fluid to be processed or reserved.

Moreover, the cable part may be provided in the frame unit 11. The cable part serves as a power supply cable configured to supply power for driving a dynamic device such as a pump 6, or a signal cable configured to output a measurement signal of a measuring device such as a flowmeter or a manometer, and input a control signal to a control device such as a control valve of a type among various types. For example, the cable part includes a conductive wire member configured to supply power or transmit a signal, and an insulating coating member surrounding the conductive wire.

The dynamic device, various measuring devices, and the control valve may be retrofitted after manufacture of the module 10 or at the time of construction of the plant 1.

For example, as illustrated in FIG. 2, the frame unit 11, the pipe structural part 3, the static device structural part 12 (processing-unit structural part or reservoir structural part), and the cable part 4 described above are integrally formed by a three-dimensional (3D) printer (additive manufacturing device) 7, thereby constructing the module 10. In FIG. 2, a module 10*a* that is semi-manufactured by the 3D printer 7 is illustrated.

As described above, each of the frame unit 11 and the pipe structural part 3 is made of, for example, a metal material, a ceramic material, or a resin material, and is lined with or thermally insulated by a different material in some cases. Further, the cable part 4 includes, for example, a conductive member made of a metal material, and a coating member made of an insulating material.

The 3D printer 7 that employs, for example, a directional energy deposition method can form a structure through combination of such different materials. For convenience of illustration, in FIG. 2, there is illustrated the 3D printer 7 forming the semi-manufactured module 10*a* through use of one nozzle. However, the module 10 may be formed through selective use of a plurality of nozzles that feed different materials, respectively.

Further, as a matter of course, the module 10 may be formed through use of the 3D printer 7 that employs a method different from the directional energy deposition method.

As illustrated in FIG. 1 and FIG. 2, through use of the 3D printer 7, the pipe structural part 3 and the static device structural part 12 can be formed while securing an internal space in which the fluid is caused to circulate or is accommodated.

In this case, when the frame unit 11 is formed into the sparse structure such as the frame structure or the lattice structure, in parallel with the structural members forming the sparse structure, main bodies (wall portions) of the processing-unit structural part, the reservoir structural part, and the pipe structural part 3 are formed. In this manner, the frame unit 11, the pipe structural part 3, and the static device structural part 12 may be integrally formed.

Further, when the frame unit 11 is formed into the solid structure, only spaces respectively corresponding to the pipe structural part 3, the processing-unit structural part, and the reservoir structural part are left in the solid structure, and the frame unit 11 is partially or entirely filled with the structural members. In this manner, the frame unit 11, the pipe structural part 3, and the static device structural part 12 may be integrally formed.

In this case, lining treatment can be performed so that the lining material is layered so as to cover an inner surface of a member defining the space corresponding to the processing-unit structural part, the reservoir structural part, or the pipe structural part 3. Alternatively, a thermal insulating member can be laminated so as to cover the member defining the space from an outer side thereof.

Moreover, the cable part 4 can be integrally formed by laminating the conductive member and the sheath member one after another. There may be adopted a configuration in which the part or entirety of the cable part 4 is retrofitted at the same time with installation of the dynamic device, the measuring device, and the control device.

Here, currently, patents have been granted for technologies for manufacturing, by the 3D printer 7, large-sized members such as aircraft fuselage parts and wings (for example, Japanese Patent No. 6513554), and building materials (for example, Japanese Patent No. 6378699). Further, based on, for example, investigations of development circumstances of 3D printer manufacturers, the inventors of the subject application have grasped that the 3D printer 7 capable of forming a structure as large as the frame unit 11 can be provided when there are demands from consumers.

Through the manufacturing steps using the 3D printer 7 described above, the module 10 can be formed. In the module 10, the frame unit 11, the pipe structural part 3, the static device structural part 12 (processing-unit structural part or reservoir structural part), and the cable part 4 have the integrated structure. The frame unit 11 has the contour having a rectangular parallelepiped shape. The pipe structural part 3, the static device structural part 12, and the cable part 4 are supported by the frame unit 11.

Here, the "integrated structure" in the embodiment of the present invention refers to a structure in which the frame unit 11, the pipe structural part 3, the static device structural part 12, and the cable part 4 are connected to each other when the module 10 is manufactured. In this case, in the processing column 21 and the heat exchanger 22, it is only required that at least a member defining a space accommodating the fluid (specifically, a main body of the above-mentioned static device structural part 12 in a case of adopting the sparse structure, or a material for forming the frame unit 11 in a case of adopting the solid structure) have the integrated structure with the frame unit 11.

Therefore, the following parts may be retrofitted: a filler and a catalyst to be fitted into the processing column 21, and a tray to be used for distillation; a tube in the heat exchanger 22 of a shell-and-tube type; and a lid for internal opening. The parts to be retrofitted may also be manufactured through use of the 3D printer 7.

Figure 3:
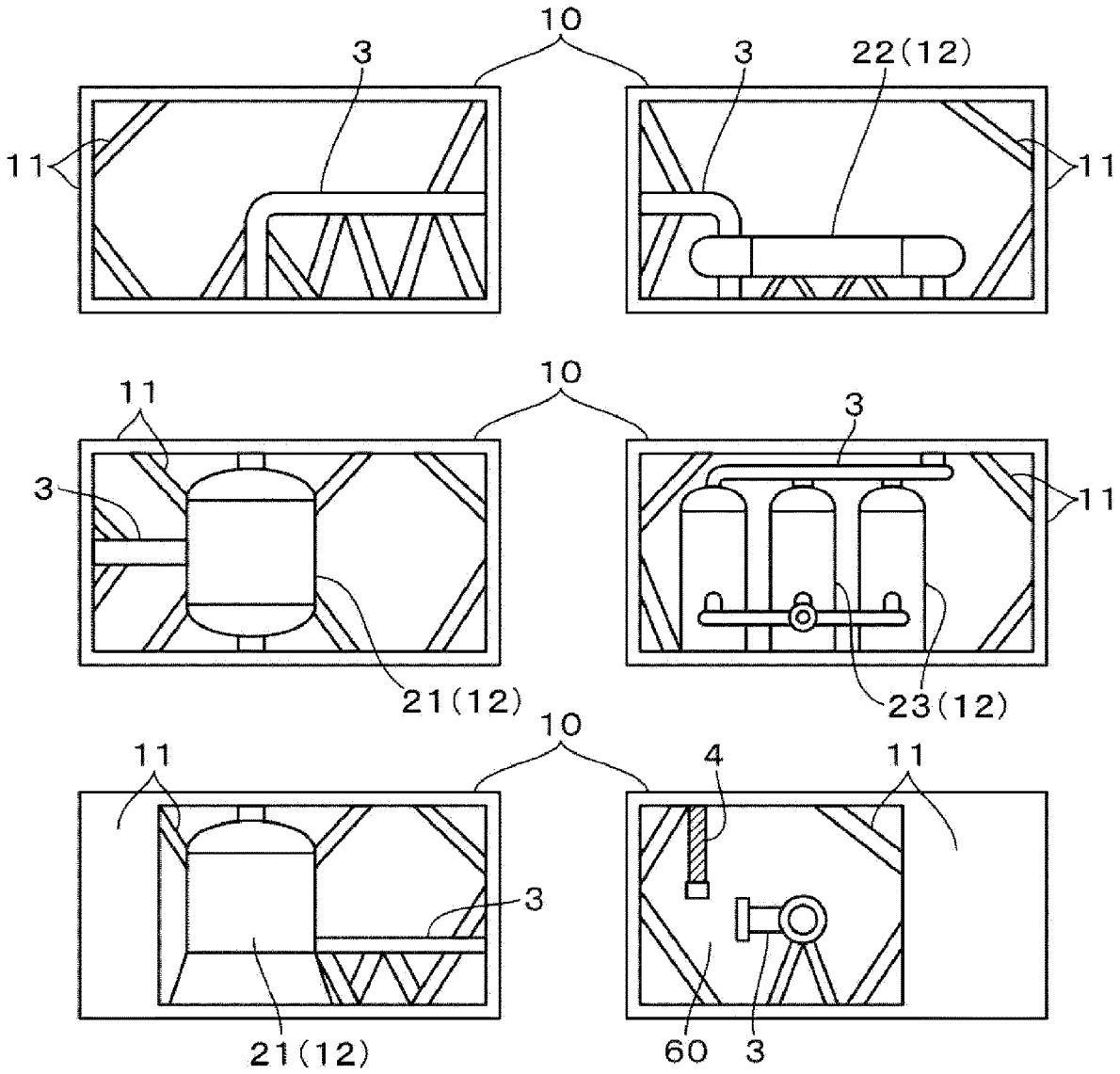
FIG. 3 is a schematic view for illustrating the modules for constructing a plant.

By the above-mentioned method using the 3D printer 7, in accordance with the number required for construction of the plant 1, as illustrated in FIG. 3, the modules 10 are manufactured so that the modules 10 have the structure in which the frame units 11, the pipe structural parts 3, the processing-unit structural parts (processing column 21 and heat exchanger 22), and the reservoir structural parts (receiver tanks 23) are integrated with each other.

Further, in FIG. 3, a position at which the pump 6 is to be arranged later in the lower right module 10 is illustrated as a pump arrangement space 60. At positions at which various dynamic devices, measuring devices, and control devices are to be arranged, there are secured, in advance, spaces in which those devices can be arranged.

Moreover, in each of the modules 10, there may be secured a space required for maintenance of each piping and each processing unit or for passage of an operator after construction of the plant 1.

Figure 8:
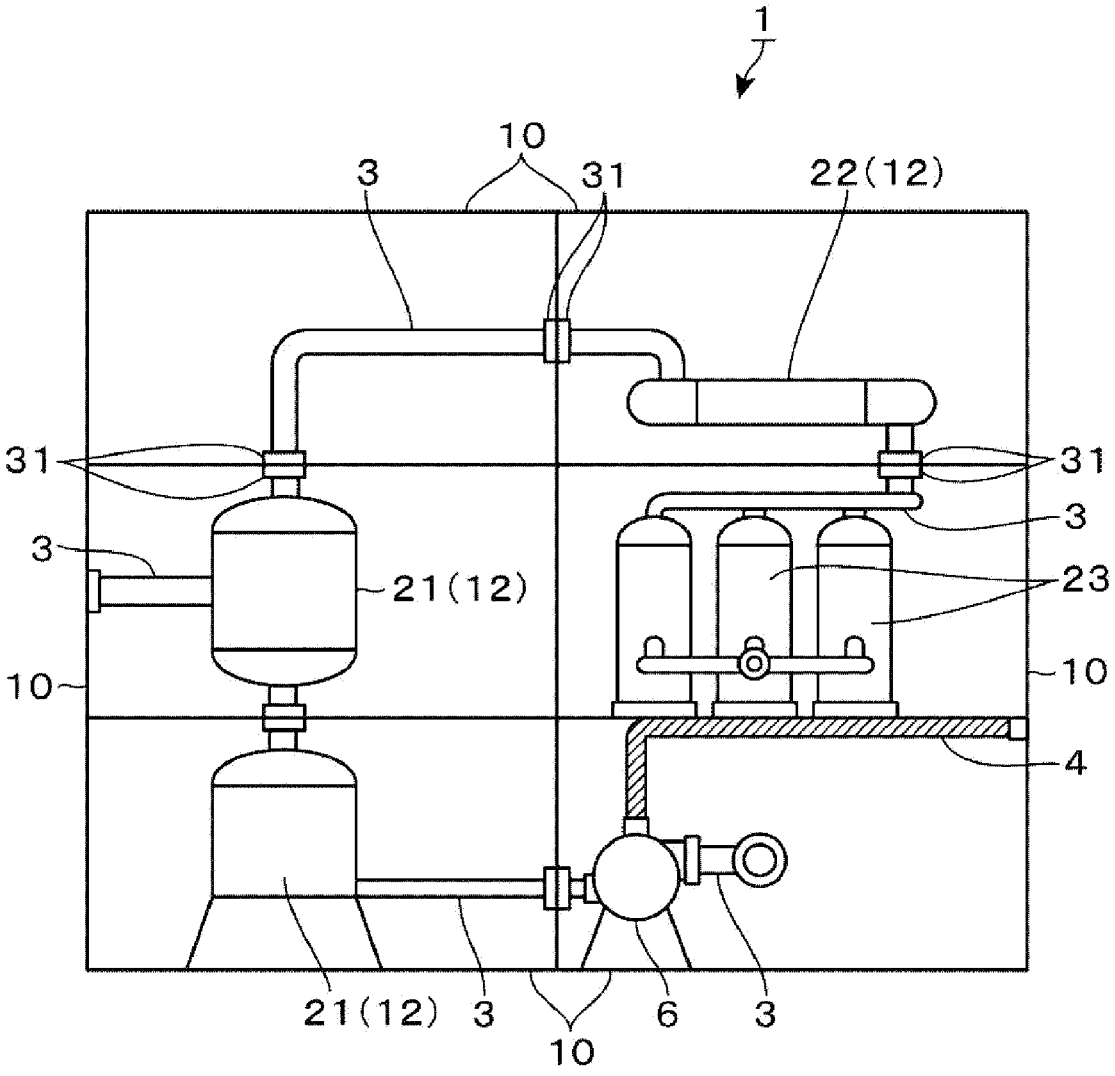
FIG. 8 is a schematic view for illustrating the plant, in which the illustration of the frame unit is omitted.

FIG. 3, FIG. 7, FIG. 9, and FIG. 10 are illustrations of examples of the frame units 11 each having the frame structure. Further, FIG. 4, FIG. 8, and FIG. 11 are views in which illustrations of the frame units 11 of the modules 10 are omitted for convenience of description.

Figure 4:
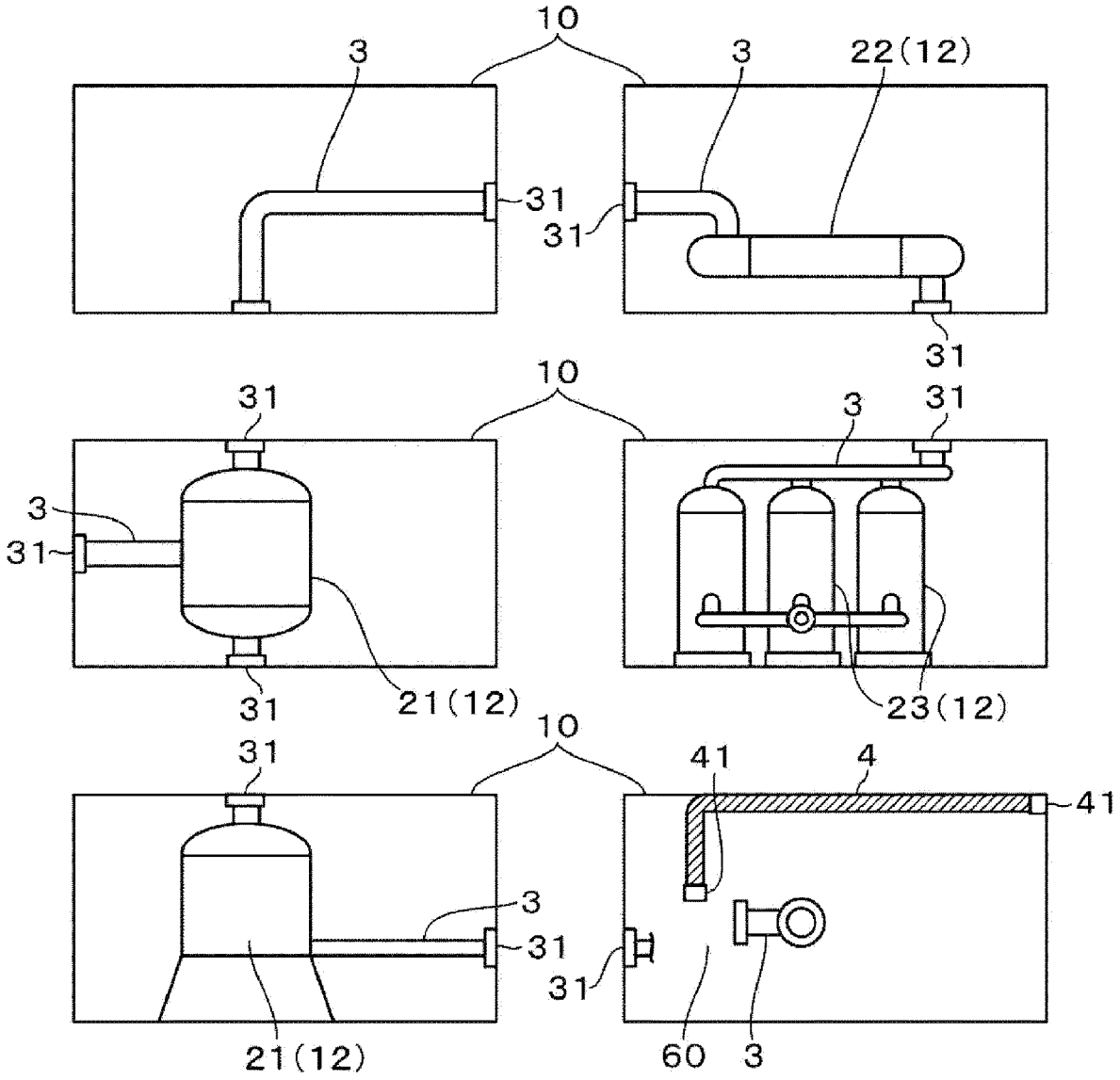
FIG. 4 is a schematic view for illustrating the modules, in which an illustration of a frame unit is omitted.

As illustrated in FIG. 4 in which illustrations of the frame units 11 are omitted, at an end portion of each of the pipe structural parts 3 facing an outer surface of the module 10, there is provided a connection portion 31 configured to connect the pipe structural part 3 to the pipe structural part 3 of another module 10 through, for example, fastening with a bolt and a nut, welding, or a coupling connection mechanism. Further, also at an end portion of the cable part 4, there is provided a connection portion 41 configured to make coupling connection of the cable part 4 with, for example, the dynamic device, the measuring device, the control device, or another cable part 4.

Figure 5:
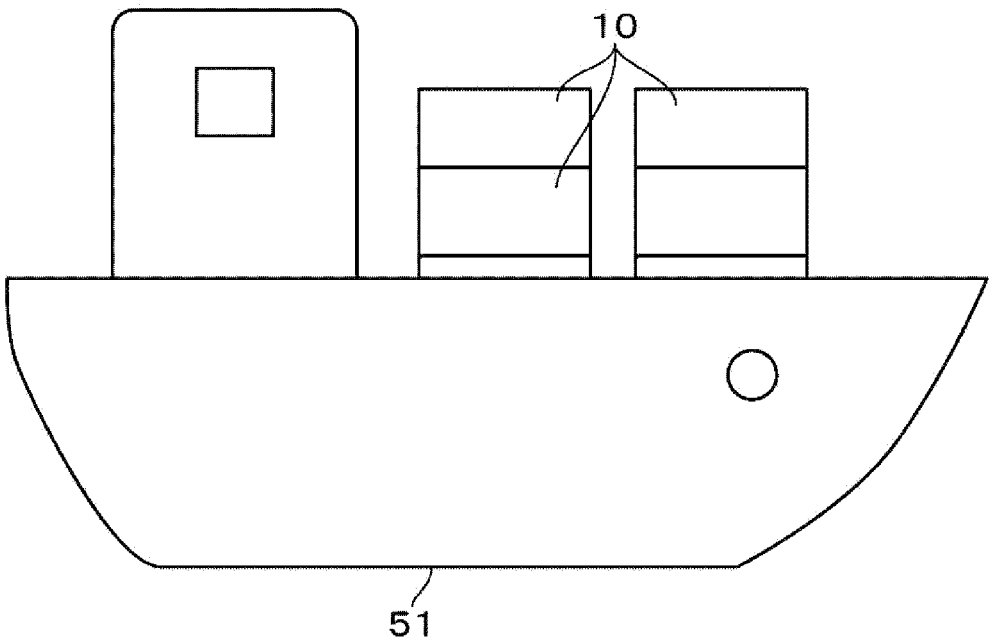
FIG. 5 is an explanatory view for illustrating a method of transporting the modules.

As schematically illustrated in FIG. 5, the plurality of manufactured modules 10 are loaded onto a general container transport ship 51, and are transported to a construction site of the plant 1.

Here, manufacture of the module 10 is not limited to a case in which the module 10 is manufactured in a place distant from the construction site of the plant 1, and then is transported. The 3D printer 7 may be arranged in the construction site of the plant 1, and the module 10 may be manufactured in this site. In this case, each module 10 may have a size larger than the container size.

Figure 6:
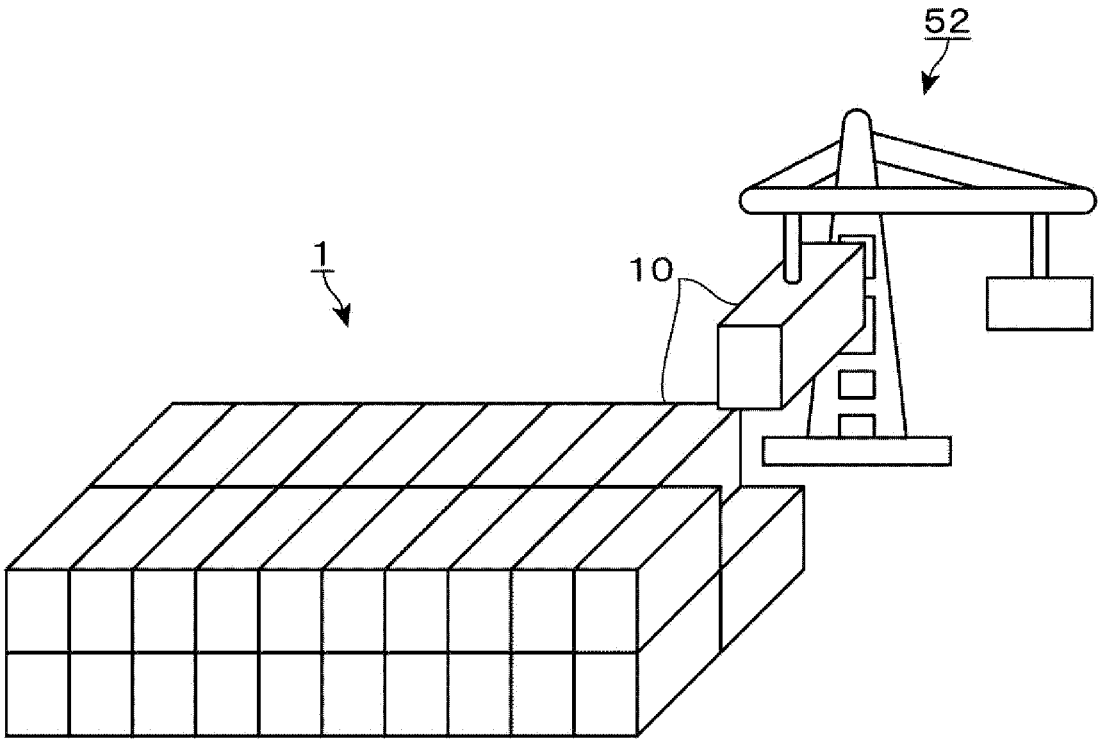
FIG. 6 is an explanatory view for illustrating construction of the plant using the modules.
Figure 7:
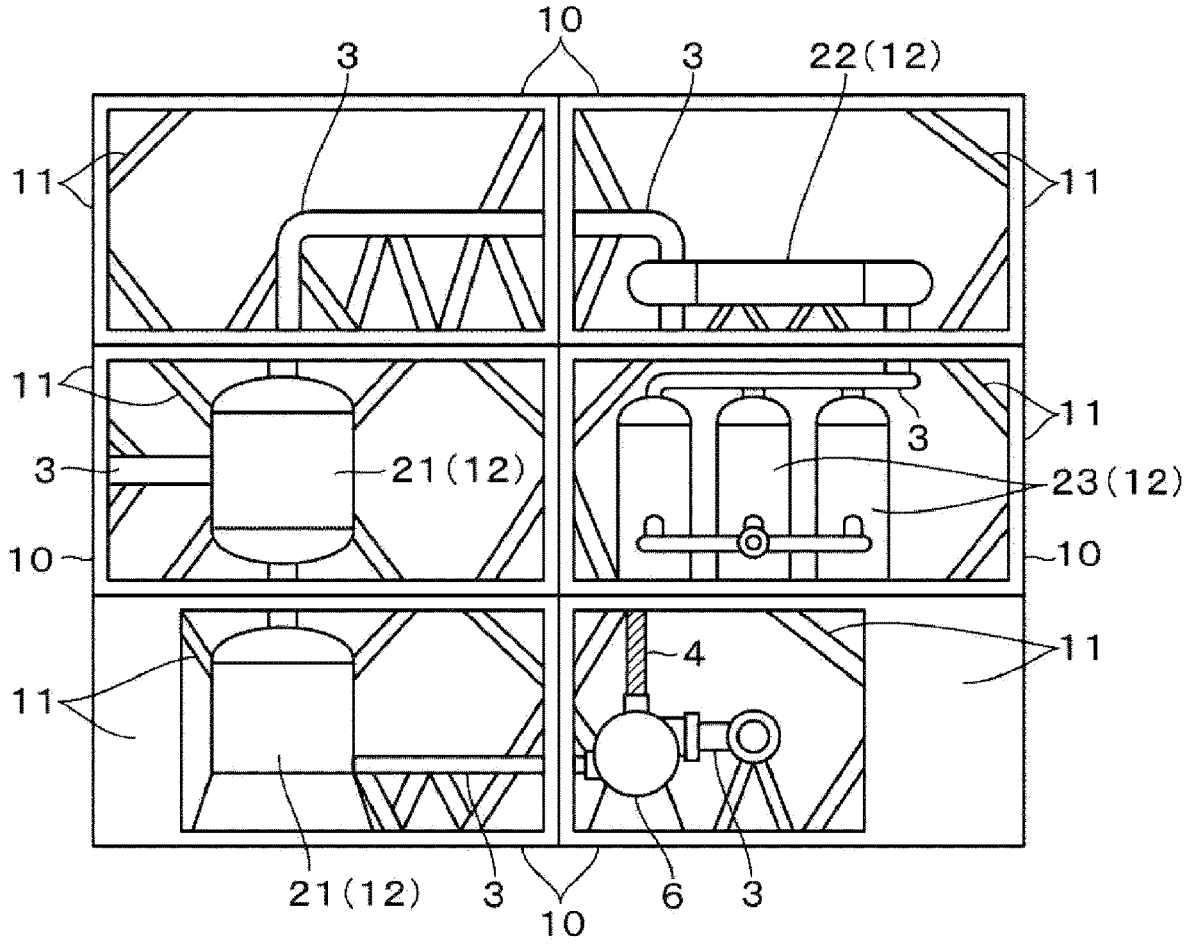
FIG. 7 is a schematic view for illustrating the plant constructed by the modules.

When the plurality of modules 10 are transported to the construction site, as illustrated in FIG. 6, in order to respectively arrange the modules 10 at proper positions in the plant 1, through use of, for example, a crane 52, there are performed a step of arranging the modules 10 in the horizontal direction, and a step of stacking the modules 10 in the up-and-down direction. Then, there is performed a step of configuring the pipe by connecting together the pipe structural parts 3 of the modules 10 that abut on each other in the horizontal direction or the up-and-down direction.

Moreover, the pump 6 is arranged in the pump arrangement space 60, and is connected to the pipe structural part 3 and the cable part 4. Each of the other dynamic device, measuring device, and control device is also arranged in an arrangement space for each of the devices, and is connected to the pipe structural part 3 and the cable part 4. Further, the catalyst and the filler are filled into the processing column 21 that is to be filled with the catalyst and the filler. Parts to be retrofitted are mounted to the processing column 21 and the heat exchanger 22 that require the parts to be retrofitted.

Arrangement of the dynamic device, the measuring device, and the control device, filling of the catalyst and the filler, and mounting of the parts to be retrofitted described above may be performed during a period from manufacture of the modules 10 and before arrangement of the modules 10 at respective positions.

Through the steps described above, as illustrated in FIG. 7 and FIG. 8, the processing-unit structural parts and the reservoir structural parts are connected to each other through intermediation of the piping, and the fluid can be fed through the piping. Thus, the plant 1 is constructed, in which the processing-unit structural part and the reservoir structural part are usable as the processing column 21, the heat exchanger 22, and the receiver tank 23.

Figure 9:
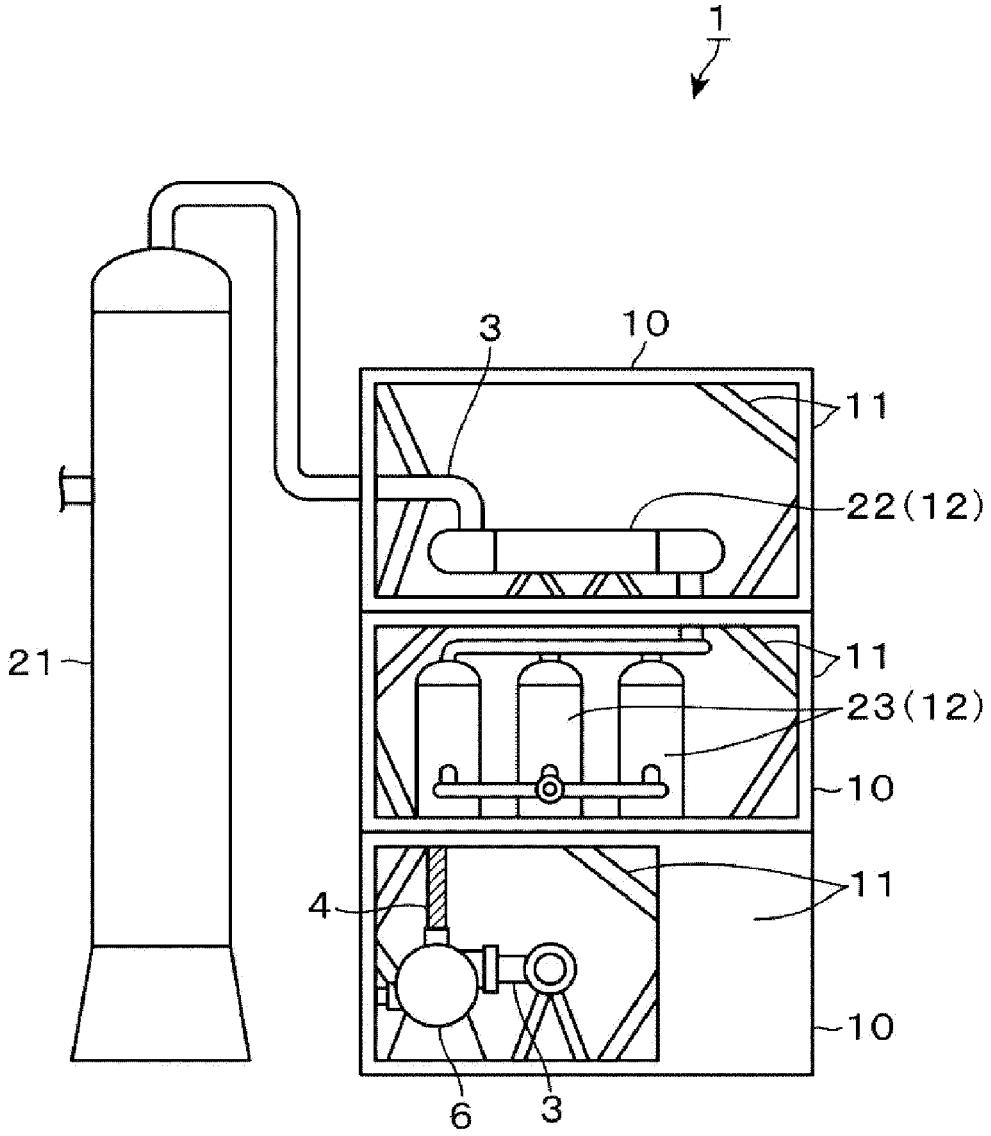
FIG. 9 is a schematic view for illustrating a plant according to a second embodiment.

Here, a large-sized device that cannot be accommodated in the module 10, such as a fractionator (processing column 21) having a large number of stages or a large-sized compressor, may be installed outside the module 10 as illustrated in FIG. 9 (in FIG. 9, an example of the tall processing column 21 is illustrated). In this case, the device arranged outside the module 10, and the static device structural part 12 arranged in the module 10 are connected to each other through intermediation of the pipe structural part 3.

Figure 10:
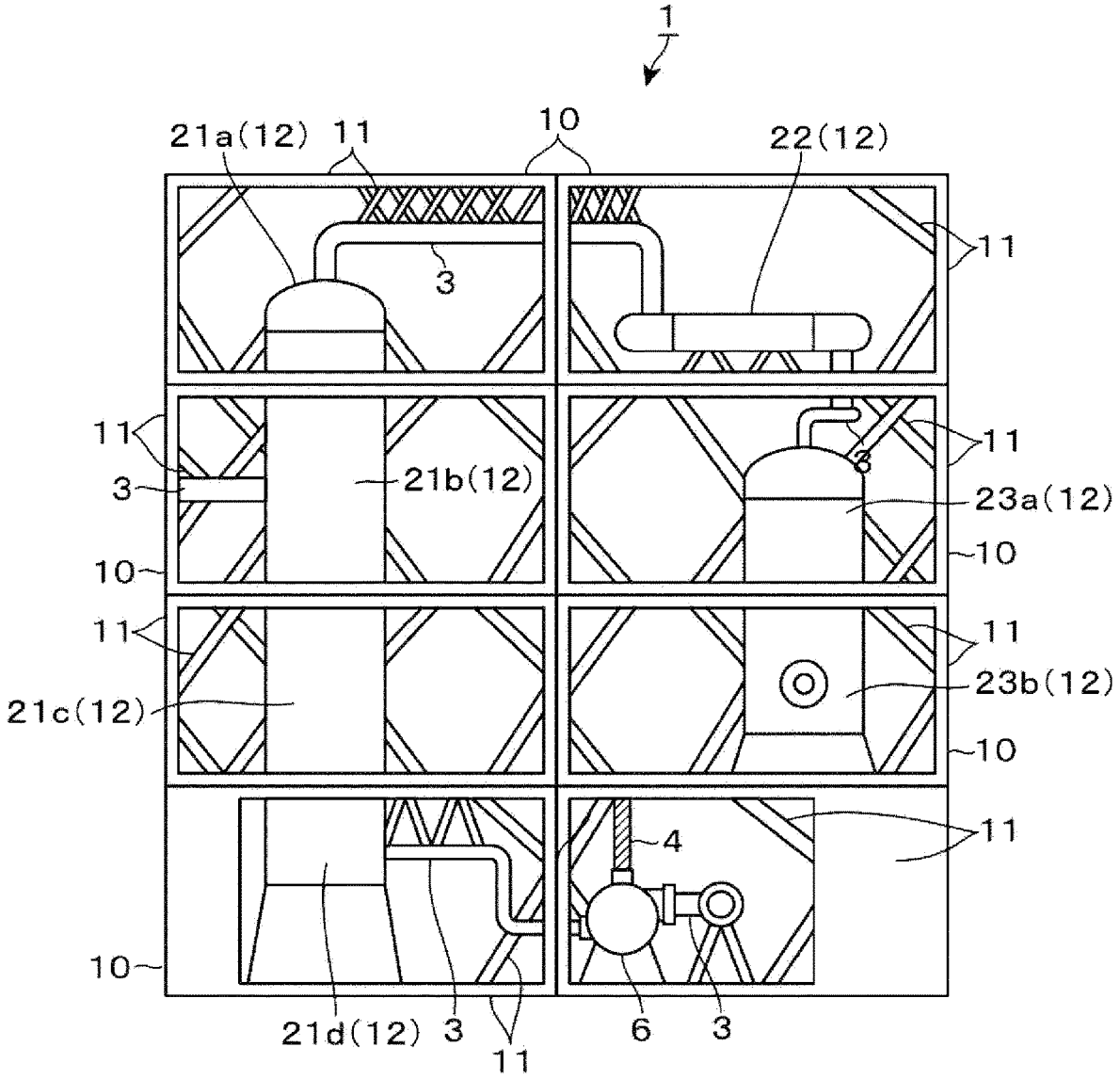
FIG. 10 is a schematic view for illustrating a plant according to a third embodiment.
Figure 11:
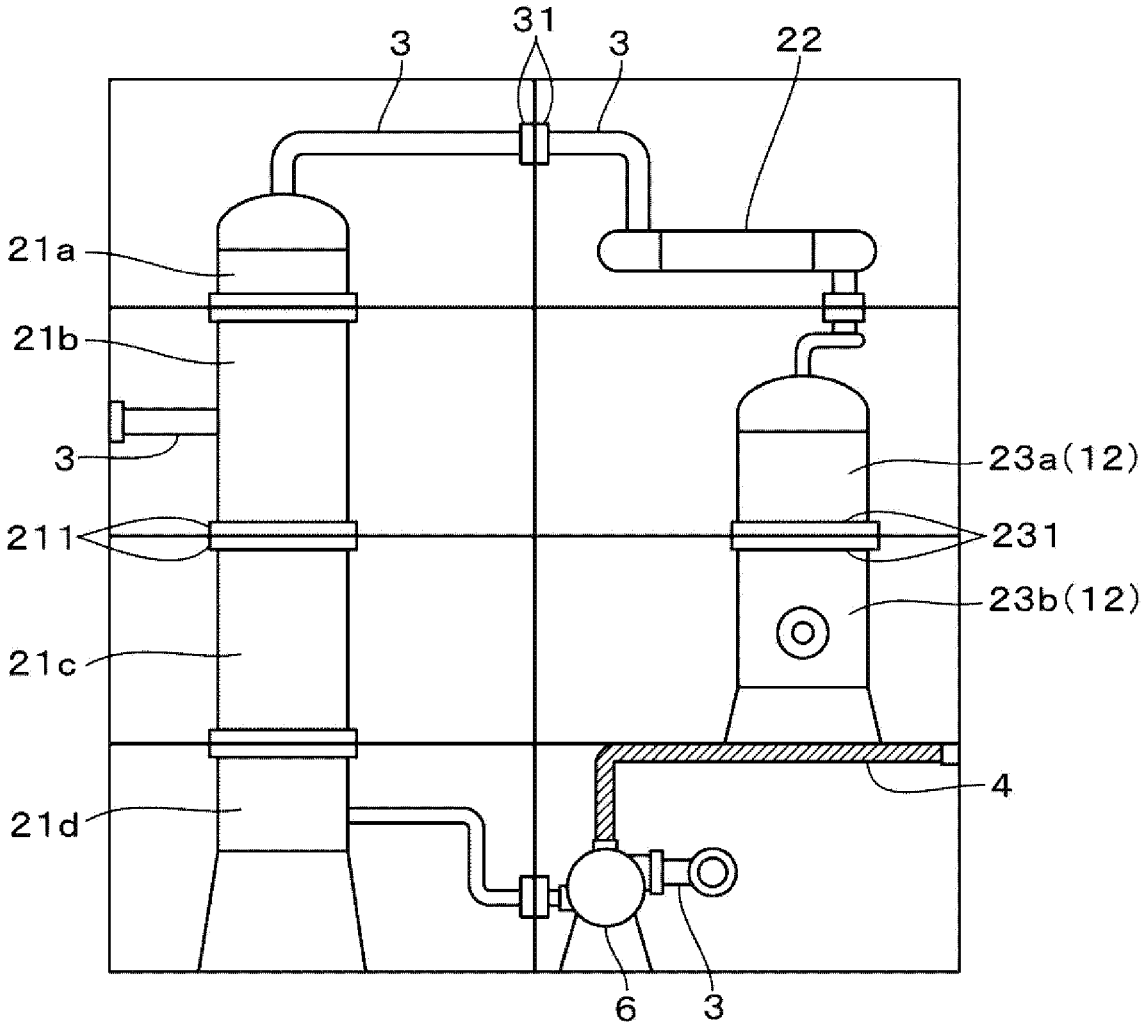
FIG. 11 is a schematic view for illustrating the plant according to the third embodiment, in which the illustration of the frame unit is omitted.

Moreover, as illustrated in FIG. 10 and FIG. 11, a large-sized static device may be formed of the processing-unit structural parts (processing column structural parts 21*a*, 21*b*, 21*c*, and 21*d*) or the reservoir structural parts (receiver tank structural parts 23*a* and 23*b*) that are divided in the up-and-down direction and accommodated in the modules 10. The divided structural parts 21*a*, 21*b*, 21*c*, 21*d*, 23*a*, and 23*b* are connected to each other by connecting portions 231 through, for example, fastening with a bolt and a nut, welding, or a coupling connection mechanism.

According to the module 10 described above, the following effects are obtained. In the module 10, the plant structural part (pipe structural part 3 or static device structural part 12) and the frame unit 11 have the integrated structure. The plant structural part constructs the plant 1, and serves as the piping, the processing unit, or the reservoir. The frame unit 11 has the contour enabling the frame units 11 to be arranged in the horizontal direction, or to be stacked in the up-and-down direction. Accordingly, in structural respects, the module 10 is suitable for integral forming (manufacture) performed by the 3D printer 7. Further, the large-sized plant 1 is easily constructed by the divided modules 10 each having a size suitable for transportation.

Here, it is not required that the contour of the frame unit 11 constructing the module 10 have a rectangular parallelepiped shape. According to the needs, the small-sized frame unit 11 may protrude from one surface of the rectangular parallelepiped, or a part of the frame unit 11 may be cut out in order to insert the frame unit 11 of another module 10.

The plant 1 may be a plant of a type among various types, such as a natural gas plant for liquefying natural gas and separating/recovering a natural gas liquid, a petroleum refining plant for distilling and desulfurizing crude oil or various intermediate products, and a chemical plant for producing a petrochemical product, an intermediate chemical product, and a polymer.

Further, the present invention is not limited to the large-sized plant 1. The technology of the present invention may be applied to a small-sized plant or a pilot plant that is to be installed in a plant having a side and a height of about several meters. In this case, each module 10 has a size smaller than the container size.

The invention claimed is:

1. A plant construction module for a plant configured to process a fluid, the plant construction module comprising:

a plant structural part including:

at least one pipe structural part, serving as at least one piping through which the fluid flows;

a processing-unit structural part, serving as a processing unit configured to process the fluid to be transferred into/from the processing unit through the at least one piping; or a reservoir structural part, serving as a reservoir configured to reserve the fluid; and a frame unit, which is configured to support the plant structural part, and has a contour enabling the frame unit to be arranged in a horizontal direction, or to be stacked in an up-and-down direction, wherein the plant structural part and the frame unit are integrally formed as an integrated structure, and an end portion of the pipe structural part is arranged at a predetermined position for connecting with an end portion of a pipe structural part of another plant construction module.

2. The plant construction module according to claim 1, further comprising:

a cable part, which is supported by the frame unit, and serves as a power supply cable configured to supply power for driving a dynamic device, or a signal cable configured to input and output a signal of an instrumentation device, wherein the cable part, the plant structural part and the frame unit are integrally formed as the integrated structure.

3. The plant construction module according to claim 1, wherein the contour of the frame unit has a rectangular parallelepiped shape.

4. The plant construction module according to claim 3, wherein the frame unit having the rectangular parallelepiped shape has such a dimension that enables transportation by a container transport ship.

5. A plant, comprising:

a plurality of the plant construction modules of claim 1 arranged in a horizontal direction, or stacked in an up-and-down direction;

the at least one piping configured by connecting together the end portions arranged at predetermined positions of the pipe structural parts of the plant construction modules that abut on each other in the horizontal direction or the up-and-down direction; and at least one of:

the processing unit, which is configured by the processing-unit structural part, and into which the fluid is to be fed through the at least one piping; or the reservoir, which is configured by the reservoir structural part, and into which the fluid is to be fed through the at least one piping.

6. A manufacturing method for a plant construction module for construction of a plant configured to process a fluid, the manufacturing method comprising:

a step of integrally constructing a plant structural part and a frame unit as an integrated structure by a 3D printer, wherein the plant structural part includes:

at least one pipe structural part, serving as at least one piping through which the fluid flows;

a processing-unit structural part, serving as a processing unit configured to process the fluid to be transferred into/from the processing unit through the at least one piping; or a reservoir structural part, serving as a reservoir configured to reserve the fluid;

wherein the frame unit is configured to support the plant structural part, and has a contour enabling the frame unit to be arranged in a horizontal direction, or to be stacked in an up-and-down direction;

wherein in the step of integrally constructing the plant structural part and the frame unit, an end portion of the pipe structural part is formed at a predetermined position for connecting with an end portion of a pipe structural part of another plant construction module.

7. The manufacturing method for a plant construction module according to claim 6, wherein in the step of integrally constructing the plant structural part and the frame unit, the integral constructing is performed on a cable part, so that the cable part, the plant structural part and the frame unit are integrally formed as the integrated structure, and the cable part is supported by the frame unit and serves as a power supply cable configured to supply power for driving a dynamic device, or a signal cable configured to input and output a signal of an instrumentation device.

8. The manufacturing method for a plant construction module according to claim 6, wherein the contour of the frame unit has a rectangular parallelepiped shape.

9. A plant construction method, comprising the steps of:

arranging, in the horizontal direction, a plurality of plant construction modules manufactured by the manufacturing method for a plant construction module of claim 6, or stacking the plurality of plant construction modules in the up-and-down direction; and configuring the at least one piping, through which the fluid flows, by connecting together the end portions arranged at predetermined positions of the pipe structural parts of the plant construction modules that abut on each other in the horizontal direction or the up-and-down direction, wherein, when the plurality of plant construction modules enable the fluid to be fed through the at least one piping, the processing-unit structural part is used as the processing unit, or the reservoir structural part is used as the reservoir.

* * * * *